US006047686A

United States Patent [19]

Böhringer et al.

[11] Patent Number: 6,047,686

[45] Date of Patent: Apr. 11, 2000

[54] SAFETY DEVICE FOR PREVENTING FUEL DISCHARGE

[75] Inventors: Harald Böhringer, Neuhausen; Lothar Mauz, Esslingen, both of Germany

[73] Assignee: Daimler-Benz AG, Stuttgart, Germany

[21] Appl. No.: 08/898,642

[22] Filed: Jul. 22, 1997

[30] Foreign Application Priority Data

Jul. 23, 1996 [DE] Germany ..... 196 29 627

[51] Int. Cl.[7] ..... F02M 37/04

[52] U.S. Cl. ..... 123/516; 137/197

[58] Field of Search ..... 123/516, 514; 137/197, 199, 517

[56] References Cited

U.S. PATENT DOCUMENTS

| | | | |
|---|---|---|---|
| 3,768,659 | 10/1973 | Miller | 55/433 |
| 4,164,919 | 8/1979 | Davis et al. | 123/434 |
| 4,352,364 | 10/1982 | Orsino | 123/197 |
| 4,732,131 | 3/1988 | Hensel | 123/516 |
| 4,751,940 | 6/1988 | Bergsma et al. | 137/199 |

FOREIGN PATENT DOCUMENTS

| | | |
|---|---|---|
| 36 02 155 | 7/1987 | Germany . |
| 37 31 206 | 7/1990 | Germany . |
| 43 02 382 | 9/1993 | Germany . |
| 43 12 857 | 10/1994 | Germany . |
| 43 21 927 | 1/1995 | Germany . |
| 40 06 465 | 2/1995 | Germany . |
| 44 25 252 | 1/1996 | Germany . |

*Primary Examiner*—Thomas N. Moulis
*Attorney, Agent, or Firm*—Klaus J. Bach

[57] ABSTRACT

In a safety device of a fuel system for an internal combustion engine including a fuel filter with a venting nozzle adapted to prevent the discharge of fuel through the venting nozzle of the fuel filter which is connected to a pump line, the safety device which is mounted on the vent nozzle of the fuel filter includes in its housing a semi-permeable foil which is gas permeable but not liquid permeable. The semi-permeable foil extends across the vent nozzle passage and a non-return valve is disposed in the vent nozzle passage for closing the vent nozzle passage if the semi-permeable foil ruptures.

4 Claims, 2 Drawing Sheets

SAFETY DEVICE FOR PREVENTING FUEL DISCHARGE

BACKGROUND OF THE INVENTION

The invention relates to a safety device for preventing the discharge of fuel from the fuel system of internal combustion engines.

In modern internal combustion engines which use electromagnetic injection valves only a fuel supply line which is under system pressure is needed for supplying fuel from the fuel tank to the engine. As a result, there is no need for the fuel rail system normally used and also a return line. Also, the heating of the fuel which occurs when it passes through the engine is avoided. In the new systems, a shortened return flow line, which no longer extends through the engine can therefore be used as it is described, for example, in DE 44 25 252 A1.

In these systems, the system pressure is controlled by a pressure controller which is integrated in the fuel filter. Such a pressure controller is known, for example, from DE 43 12 857 A2 or DE 43 02 382 A1. It has a spring chamber which needs to be vented to the atmosphere because pressure fluctuations would occur due to changes in altitude or temperature. Provided in the pressure controller is a diaphragm which is deflected due to a build-up of pressure and thus compresses a spring in the spring chamber, as a result of which the pressure control is ultimately effected. At the same time, the diaphragm prevents the fuel in the fuel-air mixture flowing through the pressure controller from escaping into the atmosphere.

The diaphragm is, however, insufficient as a safe-guard against the escape of fuel into the atmosphere since it could break and fuel could then escape. This, in turn, would result in a risk of fire or explosion as the fuel may contact hot parts of the vehicle, such as the exhaust system. According to the prior art, it is therefore known in practice to avoid this problem by providing a safety line which extends from the fuel filter, for example, to an activated charcoal filter. However, because of the additional parts and the need for mounting this line, this constitutes a problematic and expensive and therefore technically unsatisfactory solution.

In DE 43 21 927 A1, a filter unit which can be pressurized and has a degassing nozzle is described, in which the degassing nozzle is separated from the housing compartment by a gas-permeable filter.

However, this filter unit is not suitable for use in internal combustion engines since it would not withstand the high pressures which may occur in them. Moreover, in the filter unit described in this publication, the cartridge-like filter element and the degassing opening are very disadvantageous because they are of a complicated design and it is difficult to operate them.

A venting device in a fuel system is also known from DE 37 31 206 C2, which device is intended to insure reliable venting without overflow of fuel during the operation of an internal combustion engine. This is achieved by the special design of a valve seat which, while being gas permeable, is supposed to be largely liquid-tight.

However, the non-return valve described therein does not operate at low pressures, and therefore requires a high pressure on the venting device. Consequently, he venting device is not suitable for low pressures operation.

It is therefore the principal object of the invention to provide a satisfactory solution for the problems referred to above which, at the same time, safely prevents any escape of fuel at the venting nozzle of the fuel filter and the risk of fire or explosion generated thereby.

SUMMARY OF THE INVENTION

In a safety device in a fuel system including a fuel filter with a venting nozzle for an internal combustion engine adapted to prevent the discharge of fuel through the venting nozzle of the fuel filter which is connected to a pump line, the safety device which is mounted on the vent nozzle of the fuel filter includes in its housing a semi-permeable foil which is gas permeable but not liquid permeable. The foil extends across the vent nozzle passage and a non-return valve is disposed in the venting passage for closing the vent nozzle passage if the semi-permeable foil ruptures.

By the combination of a semi-permeable foil, which, while being gas-permeable, is not liquid-permeable, and a non-return valve in a housing, the escape of fuel at the venting nozzle of the fuel filter is reliably prevented, and furthermore, the arrangement can very easily be mounted on existing devices, even as a retrofit.

The fuel filter is vented by a venting opening formed in the housing.

Preferred embodiments of the invention will be described below with reference to the accompanying drawings.

DESCRIPTION OF PREFERRED EMBODIMENT

Figure 1:
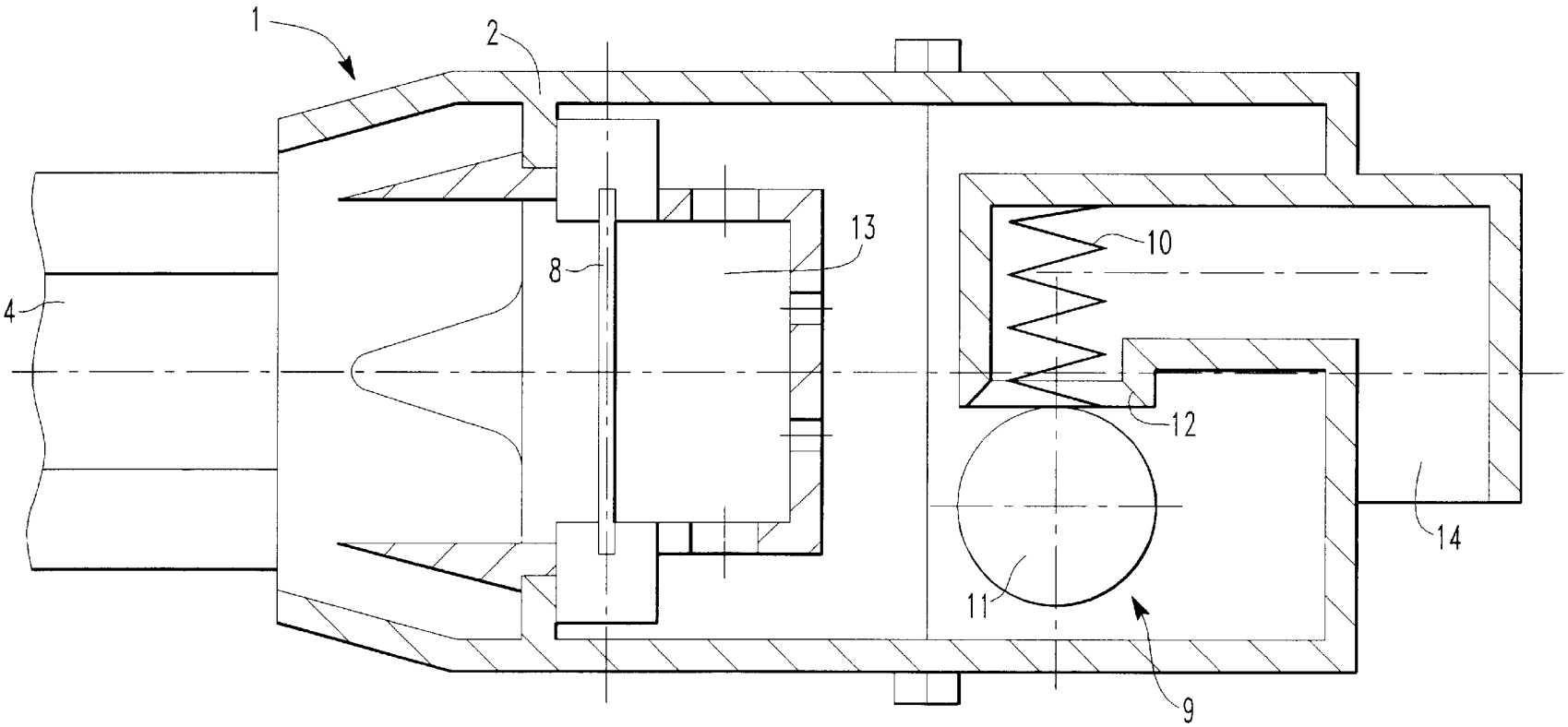
FIG. 1 is a sectional view of a safety device according to the invention.
Figure 2:
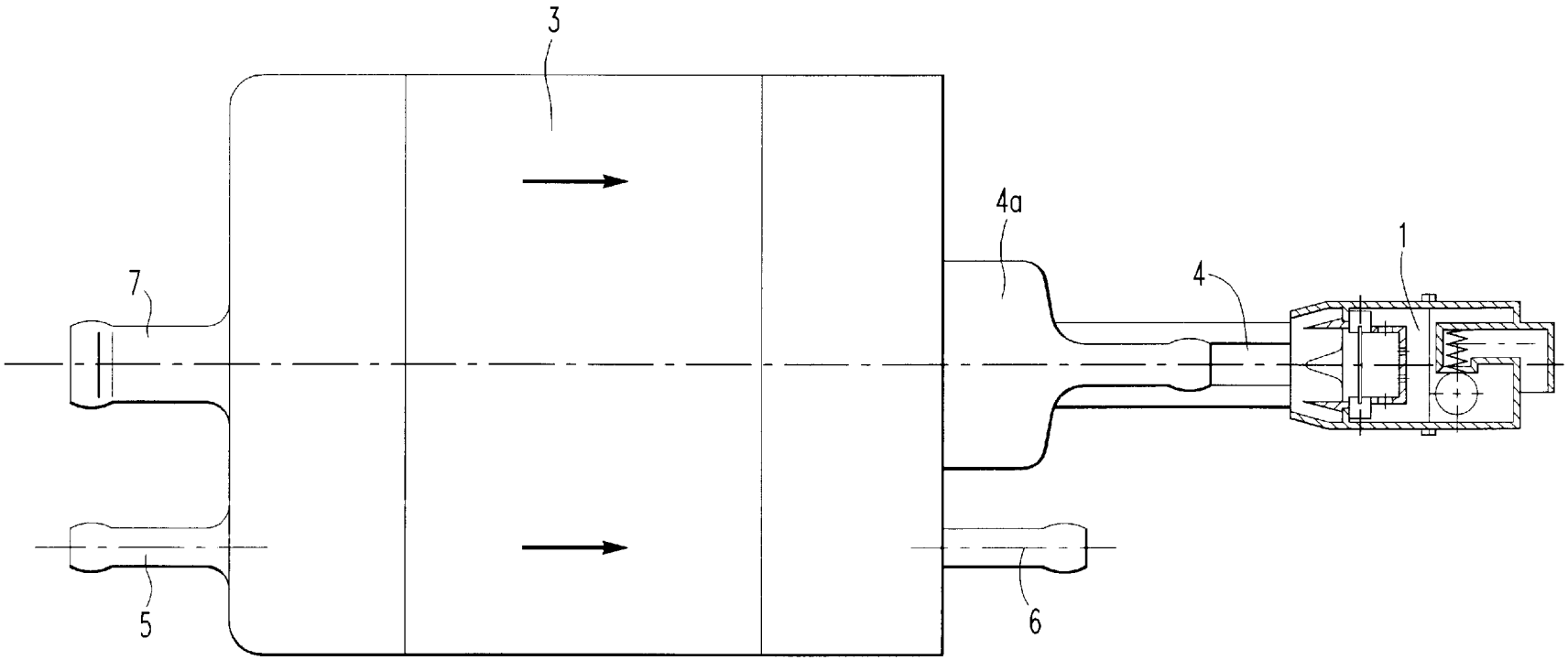
FIG. 2 shows the safety device attached to a fuel filter.

As shown in FIG. 1, a safety device 1 includes a housing 2 and is shown connected, for the purpose of venting, to a fuel filter 3 as illustrated in FIG. 2. The safety device 1 is connected to the fuel filter 3 by a vent pipe 4, which extends from a venting nozzle 4*a* on the fuel filter 3. The fuel filter 3 also includes a pump line 5, a delivery line 6 and a return line 7.

In its interior, the housing 2 of the safety device 1 has a semi-permeable foil 8 and a non-return valve 9, which in turn, includes a spring 10, a ball 11 and a valve seat 12.

Moreover, the housing 2 includes a structure for preventing solid bodies from being deposited on the foil 8. The structure is configured as a labyrinth 13.

Located in the housing 2 downstream of the non-return valve 9 is a vent opening 14, from which air flowing out of the fuel filter 3 through the vent line 4 into the safety device 1 can escape into the atmosphere.

The fuel filter also includes integrated therewith a pressure controller which is not illustrated. If a diaphragm (likewise not illustrated) in the pressure controller breaks or is somehow damaged the air flow is enriched with fuel. The fuel in this fuel-air mixture is prevented from flowing any further by the semi-permeable foil 8, which, while being gas-permeable, is not liquid permeable. The air can thus continue to flow without obstruction and can leave the safety device 1 via the non-return valve 9 and the venting opening 14.

If, however, for some reason the semi-permeable foil 8 should also become damaged, the non-return valve 9 insures that no fuel or fuel-air mixture can escape from the venting opening 14, because then the higher pressure occurring in such a case insures that the ball 11 is pressed against the valve seat 12 against the force of the spring 10, and the non-return valve 9 is thus closed. The vent opening 14 is then also closed so that there is no communication to the atmosphere.

The labyrinth 13 provided in the safety device 1 prevents solid bodies or any other type of soiling which could impair the functioning of the safety device from entering into the safety device 1 from the outside.

The device according to the invention on the one hand insures the venting of the fuel filter 3 and on the other hand reliably prevents the risk of fire or explosion caused by escaping fuel.

What is claimed is:

1. A safety device in a fuel system including a fuel filter of internal combustion engines, said fuel filter being disposed in a fuel pump line and having a filter housing with a fuel delivery line, a fuel return line and a vent line, said safety device including a housing with a vent passage with a vent discharge opening and being in communication with said vent line and a foil arranged in said housing so as to extend across said vent passage, said foil being gas-permeable, but not liquid-permeable, and with a non-return valve disposed in the vent passage between said foil and said vent discharge opening of said vent passage.

2. A safety device according to claim 1, wherein said housing includes means for preventing solid bodies from being deposited on said foil.

3. A safety device according to claim 2, wherein said means for preventing solid bodies from being deposited on is configured is a labyrinth structure.

4. A safety device according to one of claim 1, wherein said vent discharge opening leads to the atmosphere.

* * * * *